US011897651B1

(12) United States Patent
Kühnle et al.

(10) Patent No.: US 11,897,651 B1
(45) Date of Patent: Feb. 13, 2024

(54) DEVICE AND METHOD FOR TRANSFERRING A PACKAGING UNIT INTO A BARRIER SYSTEM FOR PHARMACEUTICALS

(71) Applicant: Syntegon Technology GmbH, Waiblingen (DE)

(72) Inventors: Albrecht Kühnle, Crailsheim (DE); Benjamin Hoffmann, Vellberg (DE); Ulrich Krauß, Ilshofen (DE); Markus Ilgenfritz, Feuchtwangen (DE)

(73) Assignee: Syntegon Technology GmbH, Waiblingen (DE)

( * ) Notice: Subject to any disclaimer, the term of this patent is extended or adjusted under 35 U.S.C. 154(b) by 0 days.

(21) Appl. No.: 18/547,590

(22) PCT Filed: Feb. 17, 2022

(86) PCT No.: PCT/EP2022/053884

§ 371 (c)(1),
(2) Date: Aug. 23, 2023

(87) PCT Pub. No.: WO2022/179922

PCT Pub. Date: Sep. 1, 2022

(30) Foreign Application Priority Data

Feb. 23, 2021 (DE) ..... 10 2021 104 221.6

(51) Int. Cl.
*B65B 69/00* (2006.01)

(52) U.S. Cl.
CPC ..... *B65B 69/0033* (2013.01); *B65B 69/0008* (2013.01); *B65B 69/0058* (2013.01)

(58) Field of Classification Search
CPC ..... B65B 69/0033; B65B 69/0058; B65B 69/0041; B65B 69/00; B65B 55/027; B65B 55/025

(Continued)

(56) References Cited

U.S. PATENT DOCUMENTS 9,067,699 B2 6/2015 Anatrini
11,780,631 B2 * 10/2023 Franke ..... B65B 69/0041 53/451

(Continued)

FOREIGN PATENT DOCUMENTS

DE 102009027600 1/2011
DE 102011084302 4/2013

(Continued)

OTHER PUBLICATIONS

International Search Report for Application No. PCT/EP2022/053884 dated May 27, 2022 (English Translation, 2 pages).

(Continued)

*Primary Examiner* — Glenn F Myers
(74) *Attorney, Agent, or Firm* — Michael Best & Friedrich LLP

(57) ABSTRACT

The invention relates to a device (10) and a method for transferring a packaging unit (22) into a barrier system (12) for pharmaceuticals, wherein the packaging unit comprises a sterilized container (24) and at least one sterile product (26) arranged in the latter, and wherein the packaging unit, in an initial state, is surrounded by an outer packaging (30) sterilized at least on the inside, wherein the barrier system has an access opening (20) through which the packaging unit can be transferred from a surrounding region (16) of the barrier system into an interior (14) of the barrier system, wherein a film tube (50), closed at one end, is arranged in the surrounding region of the barrier system, the interior (52) of the film tube (50) communicating with the access opening, wherein a connecting device is provided for producing a connection region between a cover portion of the outer packaging and an overlap portion of an outer face of the film tube overlapping the cover portion, and wherein a separating (Continued)

device is provided for local separation of the connection region.

13 Claims, 3 Drawing Sheets

(58) Field of Classification Search
USPC ..... 53/412, 477, 478, 373.3, 375.9, 376.2, 53/492; 414/412
See application file for complete search history.

(56) References Cited

U.S. PATENT DOCUMENTS

| | | | | |
|---|---|---|---|---|
| 2011/0142574 | A1 | 6/2011 | Schnyder | |
| 2020/0290756 | A1 | 9/2020 | Deutschle et al. | |
| 2021/0292032 | A1* | 9/2021 | Trebbi | B65B 69/0058 |

FOREIGN PATENT DOCUMENTS

| | | |
|---|---|---|
| EP | 2158128 | 3/2010 |
| EP | 2291244 | 4/2012 |

OTHER PUBLICATIONS

European Office Action for Application No. 22708526.3 dated Dec. 2, 2022 (Original and English Translation, 10 pages).
European Intention to Grant for Application No. 22708526.3 dated Jun. 7, 2023 (Original and English Translation, 42 pages).

* cited by examiner

DEVICE AND METHOD FOR TRANSFERRING A PACKAGING UNIT INTO A BARRIER SYSTEM FOR PHARMACEUTICALS

BACKGROUND

The invention relates to a device for transferring a packaging unit into a barrier system for pharmaceuticals and a method for transferring a packaging unit into a barrier system for pharmaceuticals.

Devices and methods of this type are used to be able to transfer the packaging unit with as little contamination as possible into the barrier system, wherein the packaging unit comprises a sterilized container and at least one sterile product arranged therein. If no further measures are taken, simply opening an outer packaging of the packaging unit in the surroundings of the barrier system would lead to the outer face of the container of the packaging unit being able to be contaminated, so that there would be a risk of germs being introduced into the barrier system.

It is known to provide outside the barrier system an additional region in which the packaging unit, together with the outer packaging, is subjected to an airflow and the outer packaging is separated inside the airflow in order to transport the packaging unit subsequently into the barrier system. Alternatively or additionally, an irradiation and/or a treatment using hydrogen peroxide can also take place in the additional region. Finally, it is also possible for the entire additional region to be kept sterile and for the outer packaging to be replaced for a sterile outer packaging—also on the outer face—in the additional region.

A system for transferring an object, which has been sterilized and packed in a bag, into a clean room is known, for example, from EP 2 291 244 A1.

SUMMARY

Proceeding therefrom, the object of the present invention is to specify a device and a method which permit a simple transfer of the packaging unit into the barrier system without contamination.

This object is achieved by a device according to the disclosure.

This object is achieved by a method according to the disclosure.

According to the invention, the sterile interior of the barrier system is extended into the surroundings of the barrier system and namely by the interposition of the access opening to the barrier system. The extension of this sterile interior is provided by a film tube which is closed on the end side.

For transferring the packaging unit into the interior of the film tube, a connection which extends over a connection region is produced between a cover portion of the outer packaging and an overlap portion of an outer face of the film tube, initially by using a connecting device. In this manner, the outer face of the cover portion of the outer packaging and the outer face of the film tube are connected together, wherein the outer faces can be bear directly against one another or connecting material is arranged between the outer faces.

The aforementioned connection permits a physical isolation of the outer face of the cover portion of the outer packaging in terms of contamination. While maintaining this isolation it is possible to separate the connection region—and thus also the film tube and the outer packaging—so that the connection between the overlap portion of the film tube and the cover portion of the packaging and the isolation associated therewith of the outer face of the cover portion of the container is maintained, but at the same time a through-opening is provided which makes it possible to transfer the packaging unit out of the now separated outer packaging into the now separated film tube.

Provided that the previously produced connection between the cover portion of the outer packaging and the overlap portions of the film tube is maintained as a film composite during the local separation of the connection region, it is possible for the connection region to be separated such that the cover portion of the outer packaging remains connected to the remaining outer packaging and that the overlap portion of the film tube remains connected to the remaining film tube. This has the advantage that the film composite which is produced by the connection remains connected both to the outer packaging and to the film tube such that, after a packaging unit has been transferred into the barrier system, it is possible to dispose of a cohesive unit which comprises a portion of the film tube, the film composite and the remaining outer packaging.

In this connection, it is preferred that a first part of the connection region is separated, wherein the film tube and the outer packaging remain connected together in a second part of the connection region which differs from the first part, and that—by deforming a film composite consisting of the cover portion and the overlap portion—the packaging unit is moved into the interior of the film tube.

It is particularly preferred if the deformation of the film composite is associated with the displacement thereof into the interior of the film tube. In particular, the film composite can be folded in the manner of a hinge into the interior of the film tube.

It is possible that the connection region extends across the entire surface of the cover portion and the overlap portion. It is particularly advantageous, however, if the connection region extends along a web which is closed on the peripheral side. The separation of the connection region takes place along at least one part of this web, wherein the separating region is narrower than the web, when viewed across the extent of the connection region in the surface.

The separating region is preferably also arranged such that, when viewed along the path of the web, a connection region portion remains formed in each case on either side, such that the cover portion and the overlap portion are connected together on the edge side and such that in each case adjoining portions of the outer packaging and the film tube are also connected together. This applies irrespective of whether the local separation of the connection region entirely follows the path of a web which is closed on the peripheral side or whether the separation of the connection region only takes place along a part of the path of the web which is closed on the peripheral side.

In order to transfer a plurality of packaging units, which in an initial state are surrounded in each case by a dedicated outer packaging, one after the other into the barrier system, it is preferred if the film tube is provided in the form of an endless tube. This permits the simple preparation of the device for transferring a further packaging unit into the interior of the barrier system, by disposing of a film tube piece which has been used up in a previous transfer process together with the film composite and with the remaining outer packaging of the previous packaging unit, and by providing a new unused piece of the film tube which is then connected in an overlap region to the cover portion of the outer packaging of a further packaging unit.

The endless tube can preferably be unwound from or pulled off a tube material supply which is adjacent to the access opening of the barrier system. This makes it possible to arrange the closure of the film tube on the end side in a region spaced apart from the access opening of the barrier system.

The film closure can comprise winding rollers onto which the used-up film tube and optionally the film composites connected thereto and the remaining portions of the outer packaging can be wound.

The outer packagings are preferably produced from a thermoplastic film material and are preferably provided in the form of bags. Preferred materials for such bags are polyethylene, polystyrene and "Tyvek" manufactured by DuPont.

It is possible that the aforementioned bag-like outer packaging is an inner bag which in turn is surrounded by an additional outer packaging, in particular in the form of an outer bag. In the case where the outer packaging (also here: the inner bag) should also be sterilized on the outer face and the outer bag is sterilized on the inside, it is preferred if the removal of the outer bag takes place in an additional region of the device mentioned in the introduction. As a result, an even greater level of protection can be achieved against the contamination of the packaging unit.

As explained above, it is possible for the connecting device to connect together the cover portion and the overlap portion across the planar extent thereof. It is preferred if the connecting device is configured to connect together—at least or only—the edge of the cover portion and—at least or only—the edge of the overlap portion.

It is possible that the connecting device has a heating device for fusing the material of the cover portion and the material of the overlap portion. Such a heating device is provided, for example, such that it acts across the entire connection region and a connection is produced by positioning the heating device once and/or activating the heating device once. It is also possible that the heating device can be driven in a movable manner, so that different portions of the connection region are produced, by the heating device in each case producing portions of the connection region, wherein the heating device is moved relative to the cover portion and the overlap portion.

It is also possible for the connecting device to have a dispensing device for dispensing a bonding material. The dispensing of the bonding material can also take place at the same time across the entire connection region or alternatively—with the movement/drive of the dispensing device—successively across different portions of the connection region.

In principle, it is conceivable that the separating device separates the connection region locally in a contactless manner, for example by means of an energy beam. It is particularly simple and preferred, however, if the separating device acts mechanically and has a blade or a punching element for cutting through at least one part of the connection region.

For further simplification of the handling of the packaging unit, it is preferred if the device has a station for arranging the packaging unit and the outer packaging and in which the connecting device and the separating device are operational.

It is also preferred if the device comprises a transport device for transporting the packaging unit from the station into the interior of the film tube. In a particularly preferred embodiment the base of the station serves for arranging the packaging unit and the outer packaging, wherein the base of the station is arranged below the film tube and can be lifted such that the packaging unit can be lifted to the level of the interior of the film tube.

BRIEF DESCRIPTION OF THE DRAWINGS

Further features and advantages of the invention form the subject matter of the following description and the illustrative representation of a preferred exemplary embodiment.

In the drawing.

DETAILED DESCRIPTION

Figure 1:
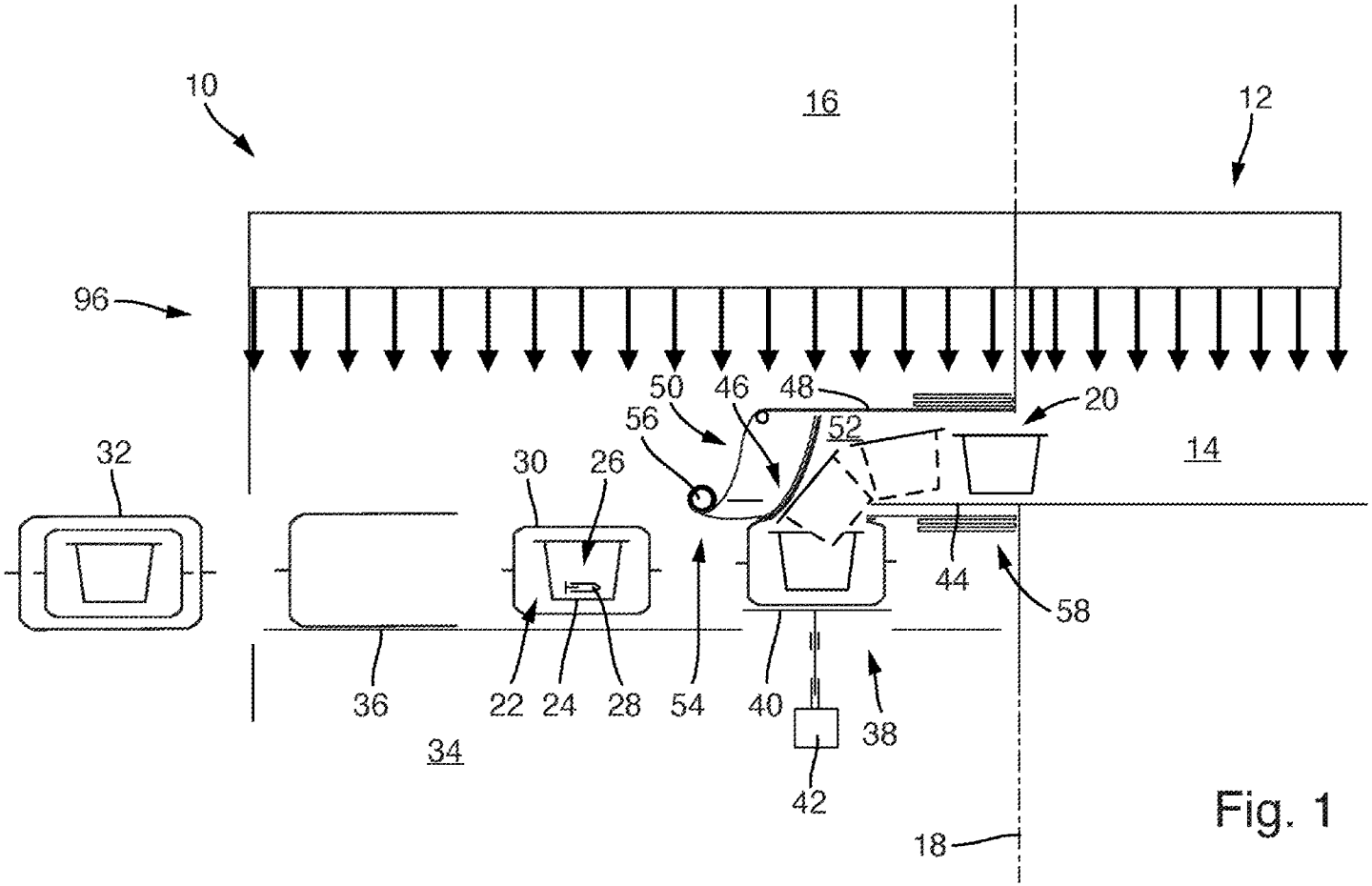
FIG. 1 shows a side view of an embodiment of a device for transferring a packaging unit into a barrier system for pharmaceuticals.

A device which is denoted in the drawing as a whole by the reference sign 10 comprises a barrier system 12 in which pharmaceuticals are handled, in particular filled. The barrier system 12 has an interior 14 which is separate from the surroundings 16 of the barrier system 12. A division between the interior 14 of the barrier system 12 and the surroundings 16 of the barrier system 12 is illustrated in the drawing by a dashed-dotted line 18. This boundary is generally formed by a wall of the barrier system 12 in which, however, an access opening 20 is provided for access to the interior 14 of the barrier system 12.

The device 10 serves to convey a packaging unit 22 from the surroundings 16 into the interior 14 of the barrier system. The packaging unit 22 has a sterilized container 24 which can be trough-shaped, i.e. open at the top. At least one sterile material 26, for example an empty syringe 28 which is to be filled in the interior 14 of the barrier system with a pharmaceutical product, is arranged in the container 24.

In an initial state or delivery state, the packaging unit 22 is surrounded by a sterilized outer packaging 30, for example a bag which is formed from film and which is optionally surrounded by an outer bag 32.

The device 10 has an inlet region 34 with a bearing surface 36 for bearing at least the packaging unit 22 and the outer packaging 30.

A station 38 adjoins the inlet region 34 with a set-up surface 40 which preferably can be adjusted flush with the bearing surface 36 and is also preferably height-adjustable by means of a transport device 42.

A receiving surface 44 which preferably extends into the interior 14 of the barrier system 12 is arranged level with a lower boundary of the access opening 20. The receiving surface 44 has a through-passage 46 which is dimensioned such that a packaging unit 22 can be transferred from the station 38 through the through-passage 46.

A support element 48 which extends parallel to the receiving surface 44 is provided level with an upper edge of the access opening 20. The receiving surface 44 and the support element 48 are encased by a film tube, denoted as a whole by the reference sign 50.

The film tube 50 is configured as an endless tube and can be pulled off a tube material supply 58 arranged adjacent to the access opening 20. The film tube 50 defines an interior 52 and is closed on the end face in a region 54 which is spaced apart from the access opening 20. The region 54 can comprise, for example, at least one winding roller 56 onto which the used-up pieces of the film tube 50 are wound.

The film tube 50 is supported at its upper end in cross section by the support element 48 and is fixed adjacent to the access opening 20. At the same time, a lower end of the film tube 50 in cross section encases the receiving surface 44 and the through-passage 46 thereof.

Figure 2:
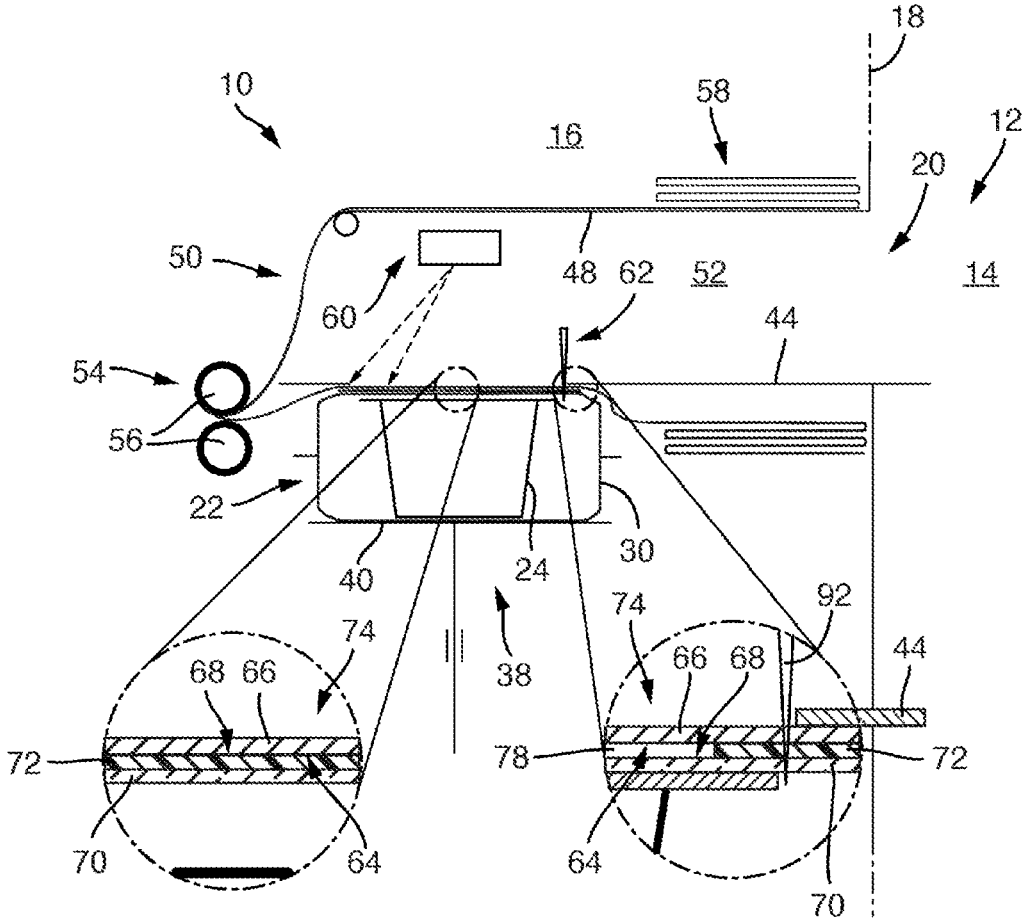
FIG. 2 shows a detail of the device according to FIG. 1, during the production of a connection region and during the subsequent separation of a part of the connection region.

The device 10 further comprises a connecting device 60 and a separating device 62 which are preferably arranged in the interior 52 of the film tube 50, see FIG. 2.

The connecting device 60 serves to produce a connection between an outer face 64 of the material 66 of the film tube 50 and an outer face 68 of a cover portion 70 of the outer packaging 30. The connection region is shown for clearer illustration in the two enlargements of FIG. 2 in the form of a connecting layer which is denoted by the reference sign 72. For example, it can be a bonding material or alternatively a region (graphically illustrated) in which the material of the cover portion 70 of the outer packaging 30 and an identically sized overlap portion 74 of the material 66 of the film tube 50 are connected together, in particular fused together.

Figure 3:
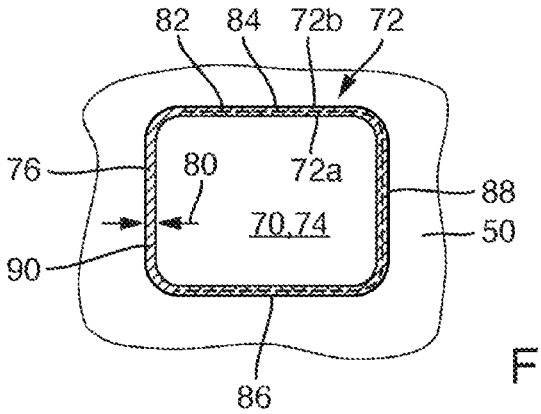
FIG. 3 shows a plan view of the partially separated connection region.

The connection region 72 preferably extends along a web 76 which is closed on the peripheral side, see FIG. 3. The web 76 defines a free space 78 which is defined between the cover portion 70 and the overlap portion 74, see FIG. 2. Germs arranged on the outer face 68 of the cover portion 70 of the outer packaging 30, therefore, are enclosed between the cover portion 70 and the overlap portion 74 of the film tube 50 and at the same time inside the web-shaped connection region 72.

A width 80 of the web 76, which is measured in the extension plane of the connection region 72, is preferably at least 2 mm, in particular at least 4 mm.

Proceeding from the production of the connection region 72, the separating device 62 serves to separate locally the connection region 72. This separation can take place along the entire web-shaped path of the connection region 72; but it is preferred if a separating region 82 extends only across a first part of the connection region 72. This is illustrated in FIG. 3 by a dashed line; the separating region 82 extends, for example, along opposing side edges 84 and 86 and along a front edge 88 of the connection region 72. A second part 90 of the connection region 72 remains unchanged, and thus in this second part 90 is not locally separated. In particular, this is a rear edge of the connection region 72.

During the local separation of the connection region 72, the separating device 62 also cuts through the material of the film tube 50 and the material of the outer packaging 30, for example by using a blade 92, see FIG. 2. When viewed across the width 80 of the web 76, the separating region is arranged such that, after locally separating the connection region 72 and at the same time cutting through the material of the film tube 50 and the material of the outer packaging 30 on both sides of the separating region, the respective portions 72*a* and 72*b* of the connection region 72 are maintained.

Figure 4:
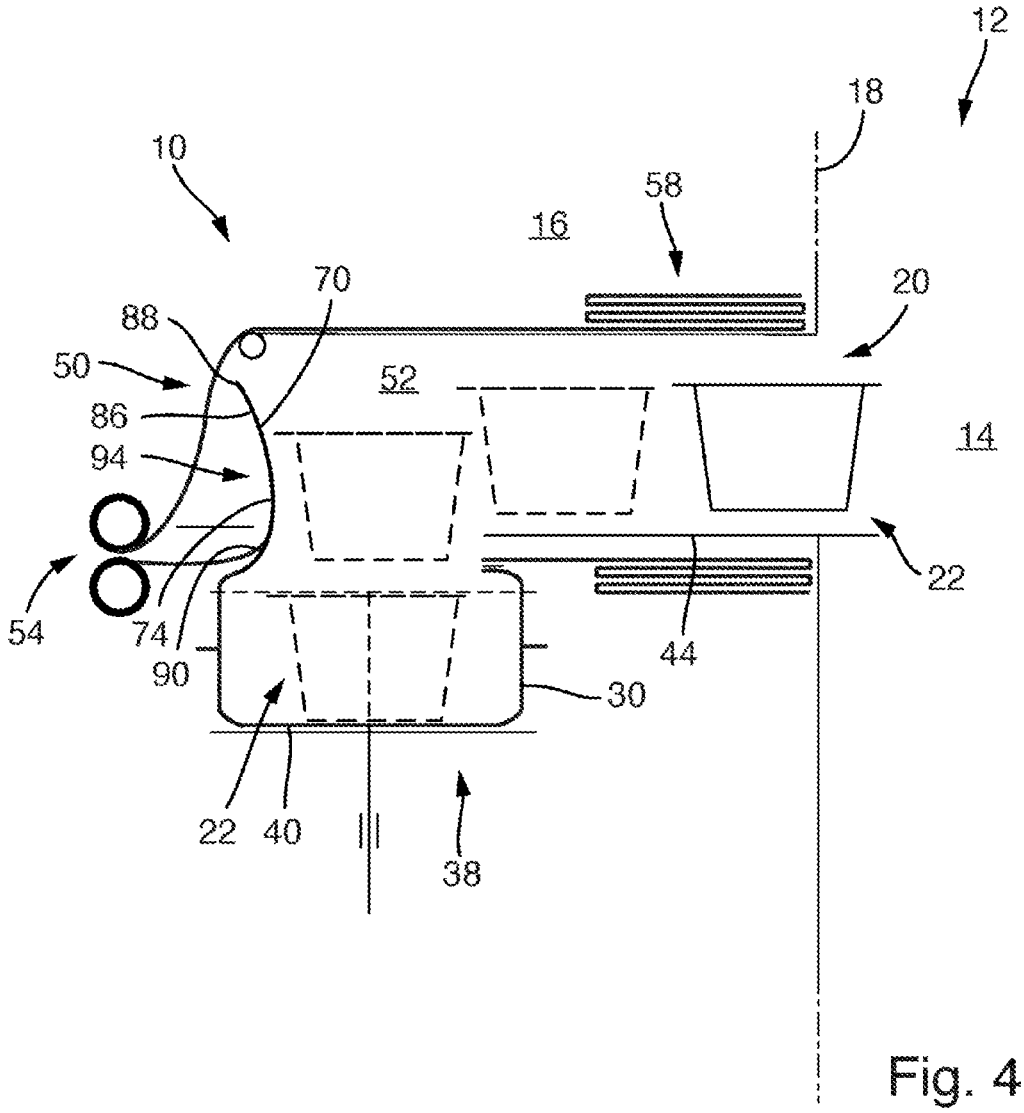
FIG. 4 shows a further detail of the device according to FIG. 1 during the transport of the packaging unit into the barrier system.

Proceeding from a state in which the cover portion 70, the overlap portion 74 and the connection region 72 are separated at least along a part of the web-shaped connection region 72, the packaging unit 22 is transported out of the station 38 into the interior 52 of the film tube 50, see FIG. 4. Preferably, the set-up surface 40 is lifted until it has reached the height of the receiving surface 44. The packaging unit 22 is inserted through the through-passage 46 of the bearing surface 44 into the interior 52. A film composite 94 consisting of the cover portion 70 and the overlap portion 74, which are connected together, is pushed into the interior 52 of the film tube 50. As a result of the connection in the region of the rear edge/in the region of the second part 90 of the connection region 72, the film composite 94 is folded back to the side so that the packaging unit 22 is transferred past the folded-back film composite 94 into the interior 52 of the film tube 50. The packaging unit 22 can be transferred therefrom in a manner known per se into the interior 14 of the barrier system 12, for example by means of transport elements known per se, for example slides or grippers.

Following a transfer of a first packaging unit 22 into the interior 14 of the barrier system 12, the film tube 50 can be pulled off the supply 58, wherein at the same time the film composite 94 and the remaining constituent parts of the outer packaging 30 can be removed and collected. After a "fresh" piece of film tube has been provided, a further packaging unit 22 can be transferred in the manner described above into the interior 14 of the barrier system 12.

It is possible that a flow device 96 is provided for further increasing the protection against contamination, (see FIG. 1), the flow device subjecting the surroundings 16 and/or the interior 14 of the barrier system 12 to a defined airflow which is oriented from top to bottom, for example.

The invention claimed is:

1. A device (10) for transferring a packaging unit (22) into a barrier system (12) for pharmaceuticals, wherein the packaging unit (22) comprises a sterilized container (24) and at least one sterile product (26) arranged therein and wherein the packaging unit (22), in an initial state, is surrounded by an outer packaging (30) sterilized at least on the inside, wherein the barrier system (12) has an access opening (20) through which the packaging unit can be transferred from a surrounding region (16) of the barrier system (12) into an interior (14) of the barrier system (12), wherein a film tube (50) which is closed on the end side is arranged in the surrounding region (16) of the barrier system (12), the interior (52) of the film tube communicating with the access opening (20), characterized in that a connecting device (60) is provided for producing a connection region (72) between an outer face (68) of a planar cover portion (70) of the outer packaging (30) and a planar overlap portion (74) of an outer face (64) of the film tube (50) overlapping the cover portion (70), and in that a separating device (62) is provided for locally separating the connection region (72) and for cutting through the material (66) of the film tube (50) and the material of the outer packaging (30), wherein the connection between the overlap portion (74) of the film tube (50) and the cover portion (70) of the outer packaging (30) and an isolation associated therewith of the outer face (68) of the cover portion (70) of the container (24) is maintained, but at the same time a through-opening is produced, which makes it possible to transfer the packaging unit (22) out of the outer packaging (30) into the interior (52) of the film tube (50).

2. The device (10) as claimed in claim 1, characterized in that the connection region (72) extends along a web (76) which is closed on the peripheral side.

3. The device (10) as claimed in claim 1, characterized in that the film tube (50) is provided in the form of an endless tube.

4. The device (10) as claimed in claim 3, characterized in that the endless tube can be unwound from or pulled off a tube material supply (58) which is adjacent to the access opening (20).

5. The device (10) as claimed in claim 1, characterized in that the connecting device (60) is configured to connect together the edge of the cover portion (70) and the edge of the overlap portion (74).

6. The device (10) as claimed in claim 1, characterized in that the connecting device (60) has a heating device for fusing the material of the cover portion (70) and the material of the overlap portion (74).

7. The device (10) as claimed in claim 1, characterized in that the connecting device (60) has a dispensing device for dispensing a bonding material.

8. The device (10) as claimed in claim 1, characterized in that the separating device (62) has a blade (92) or a punching element for cutting through at least one part of the connection region (72).

9. The device (10) as claimed in claim 1, characterized in that the device (10) has a station (38) for arranging the packaging unit (22) and the outer packaging (30) and in which the connecting device (60) and the separating device (62) are operational.

10. The device (10) as claimed in claim 9, characterized in that the device (10) comprises a transport device (42) for transporting the packaging unit from the station (38) into the interior (52) of the film tube.

11. A method for transferring a packaging unit (22) into a barrier system (12) for pharmaceuticals, wherein the packaging unit (22) comprises a sterilized container (24) and at least one sterile product (26) arranged therein and wherein the packaging unit (22), in an initial state, is surrounded by an outer packaging (30) sterilized at least on the inside, wherein the barrier system (12) has an access opening (20) through which the packaging unit (22) can be transferred from a surrounding region (16) of the barrier system (12) into an interior (14) of the barrier system (12), wherein a film tube (50) which is closed on the end side is arranged or is to be arranged in the surrounding region (16) of the barrier system (12), the interior (52) of the film tube communicating with the access opening (20), characterized in that a connection region (72) is produced between an outer face (68) of a planar cover portion (70) of the outer packaging (30) and a planar overlap portion (74) of an outer face (64) of the film tube (50) overlapping the cover portion (70), in that subsequently the connection region (72) or a part of the connection region (72) is locally separated and at the same time the material (66) of the film tube (50) and the material of the outer packaging is cut through, wherein the connection between the overlap portion (74) of the film tube (50) and the cover portion (70) of the outer packaging (30) and an isolation associated therewith of the outer face (68) of the cover portion (70) of the container (24) is maintained, but at the same time a through-opening is produced, and in that the packaging unit (22) is moved out of the outer packaging (30) through the through-opening into the interior (52) of the film tube (50) and is transferred therefrom into the interior (14) of the barrier system (12).

12. The method as claimed in claim 11, characterized in that a first part (84, 86, 88) of the connection region (72) is separated, wherein the film tube (50) and the outer packaging (30) remain connected together in a second part (90) of the connection region (72) which differs from the first part, and in that—by deforming a film composite (94) consisting of the cover portion (70) and the overlap portion (74)—the packaging unit (22) is moved into the interior (14) of the film tube (52).

13. The method as claimed in claim 12, characterized in that the deformation of the film composite (94) is associated with the displacement thereof into the interior (52) of the film tube (50).

* * * * *